US006478269B2

(12) United States Patent
Forsberg

(10) Patent No.: US 6,478,269 B2
(45) Date of Patent: Nov. 12, 2002

(54) LONGITUDINALLY ADJUSTABLE LEG ASSEMBLY

(75) Inventor: Matts Forsberg, Mörrum (SE)

(73) Assignee: Svenska Kenab Karlshamns Ergonomi, Brakne-Hoby (SE)

( * ) Notice: Subject to any disclaimer, the term of this patent is extended or adjusted under 35 U.S.C. 154(b) by 0 days.

(21) Appl. No.: 09/978,079

(22) Filed: Oct. 17, 2001

(65) Prior Publication Data

US 2002/0043596 A1 Apr. 18, 2002

(51) Int. Cl.[7] ..... F16M 11/24

(52) U.S. Cl. ..... 248/188.5; 248/161; 248/188.2; 248/188.4; 248/404; 248/405; 248/550; 108/148; 108/147.19; 108/20

(58) Field of Search ..... 248/404, 405, 248/406.2, 161, 178.1, 188.5, 188.2, 550, 188.4; 108/147, 147.19, 20; 297/344.2

(56) References Cited

U.S. PATENT DOCUMENTS

| | | | | |
|---|---|---|---|---|
| 2,065,952 A | * | 12/1936 | Trautmann | 108/147 |
| 5,282,593 A | | 2/1994 | Fast | |
| 5,495,811 A | * | 3/1996 | Carson et al. | 108/147 |
| 6,158,809 A | * | 12/2000 | Gobbers et al. | 248/405 |

FOREIGN PATENT DOCUMENTS

| | | | |
|---|---|---|---|
| AT | 203703 | * | 11/1958 |
| EP | 0 283 103 A1 | | 9/1988 |

* cited by examiner

*Primary Examiner*—Leslie A. Braun
*Assistant Examiner*—Deborah Brann
(74) *Attorney, Agent, or Firm*—Browdy and Neimark, P.L.L.C.

(57) ABSTRACT

A longitudinally adjustable leg assembly, comprising a holder (9, 12) which is adapted to be fixed to the underside of a table top (1); first and second elongate carrier elements (2, 3) which are directed away from the holder (9, 12) and cooperate by threaded engagement. The first carrier element (2) is mounted rotatably but axially immovably in the holder (9, 12) and one (2; 3) of the first and second carrier elements (2, 3) having an external thread and the other (3; 2) of the first and second carrier elements (2, 3) being a tube having an internal thread portion at one end in threaded engagement with the external thread. An electric motor is arranged for rotating the first carrier element (2). A device is arranged for interrupting the current to the motor when the leg assembly is in a limit position of maximum or minimum length. The device comprising two switches (19, 20) and an actuator (21), which is adapted to actuate one of the two switches (20) when the leg assembly is in the limit position of maximum length and the other of the two switches (19) when the leg assembly is in the limit position of minimum length. A limit position wire (25) is attached to the actuator (21) for controlling the same when the leg assembly is in its limit position of maximum length.

12 Claims, 3 Drawing Sheets

LONGITUDINALLY ADJUSTABLE LEG ASSEMBLY

FIELD OF THE INVENTION

The present invention relates generally to a longitudinally adjustable leg assembly, which is adapted to be attached to the underside of a table top.

BACKGROUND ART

Many people have work assignments which cause them to sit still all day and, for instance, work at a computer. It is therefore becoming more and more important to create a workplace that affords a good working posture, which requires that the height of working table and work surface be variable.

Consequently it has become more and more common to have vertically adjustable tables which can be adjusted so that the working posture will be as good as possible and moreover makes it possible for several people to share the workplace. Vertically adjustable tables which make it possible to vary the user's working posture between sitting and standing result in an additional improvement of the workplace since a varied working posture wears less on the user's body.

The vertical adjustability is usually controlled by adjusting the length of the legs of the table, and it is advantageous if this does not have to be made manually, but instead can be effected using e.g. an electric motor.

A problem with electric motors for adjusting the length of table legs is, however, that parts of the electric motor are rapidly worn. When the motor drives the leg to a limit position where the leg is at its longest or shortest, the movable parts of the motor are subjected to heavy wear. This wear arises when the leg in the limit position stops moving and the motor is exposed to a high load since it continues trying to drive the leg past the limit position.

One way of controlling the maximum and minimum height of a table leg is shown in EP 0 283 103. An electric motor is incorporated in the table leg for driving a screw spindle. The electric motor is connected to the lower free end of said screw spindle and suspended freely thereon in the lower leg part. The motor is movable up and down in the lower leg. Microswitches are arranged on a spindle nut for cooperation with the motor. The solution requires a number of leads arranged between movable parts inside the leg.

SUMMARY OF THE INVENTION

An object of the present invention is to minimise wear on an electric motor for a longitudinally adjustable leg assembly and, thus, increase the service life of the motor. A further object of the invention is to provide a limit switch for an electric motor, which performs the setting of the length of a leg assembly. Still another object is to provide a limit switch which is of a simple construction and whose function does not prevent the motor from setting the length of the leg within a permissible range.

According to the invention, the objects are achieved by means of a longitudinally adjustable leg assembly, comprising a holder which is adapted to be fixed to the underside of a table top, and first and second elongate carrier elements which are directed away from the holder and cooperate by threaded engagement. The first carrier element is mounted rotatably but axially immovably in the holder and has preferably an external thread. The second carrier element is preferably a tube having an internal thread portion at an end enclosing the first carrier element, in threaded engagement with the external thread of the first carrier element. The leg assembly further comprises an electric motor for rotating the first carrier element, and a device for interrupting the current to the motor when the leg assembly is in a limit position of maximum or minimum length and a limit position wire. The device for interrupting comprises two switches and an actuator, which is adapted to actuate one of the two switches when the leg assembly is in the limit position of maximum length and the other of the two switches when the leg assembly is in the limit position of minimum length. The limit position wire is attached to the actuator for controlling the same when the leg assembly is in its limit position of maximum length.

By means of the device for interrupting the current, it is ensured that the motor does not try to drive the leg assembly past a limit position, thus preventing unnecessary and heavy wear on the motor and its components. Moreover, the device for interrupting is designed so that a situation when both switches are switched off cannot arise since only one actuator is available. This prevents a position where the leg assembly gets stuck on a certain level. Moreover, the device for interrupting has but a few components, which results in a simple device with a small risk of jamming. The limit position wire is fixed to the actuator for controlling the same, i.e. its actuation of the switch, when the leg assembly is in its limit position of maximum length. This means that the actuator is moved when it is to actuate one of the switches. The limit position wire makes it possible for the actuator to be moved when the leg assembly has reached its limit position of maximum length.

The device for interrupting with its two switches is preferably arranged at an upper end of the first carrier element.

As a result, there is no problem with wires extending along the carrier elements of the leg assembly. In fact, these move when the length of the leg assembly is being set, which would make it difficult to mount wires to the switches in a safe manner. The position of the witches also implies that the device for interrupting an be placed in such manner that the switches are not moved relative to the table top when the length of the leg assembly is being set. As a result, there is no need for wires that accompany the motions of the carrier elements, which would be still more complicated. Moreover the motor is often arranged close the upper end of the first carrier element since this is driven by the motor. This means that short wires can be used, which is always advantageous.

The limit position wire has advantageously a lower abutment, with which the second carrier element interacts for controlling of the actuator when the leg assembly is in its limit position of maximum length.

As a result, power transmission from the second carrier element to the limit position wire can easily be obtained when the leg assembly has reached this limit position. The limit position wire is then actuated by the second carrier element so as to control the actuator to actuate one of the switches.

In the case with two carrier elements, the second carrier element can advantageously be arranged to interact, directly or indirectly, with the actuator for controlling the same when the leg assembly is in its limit position of minimum length.

As a result, it will be possible to arrange the switches close to each other. Nor does the user have to consider in the leg assembly an actuator which moves when the length of the leg assembly is being adjusted in the areas outside the limit positions.

The actuator is suitably spring actuated towards a neutral position where none of the switches is actuated.

This requires that the actuator be subjected to a certain degree of minimum force so as to be moved, thereby actuating one of the switches. This ensures that none of the switches is actuated owing to some minor interference and that a good function is maintained. Only when the leg assembly reaches a limit position, the actuator is subjected to a sufficient degree of force for one of the switches to be actuated.

The device for interrupting preferably comprises two springs, which from one direction each urge the actuator towards the neutral position where none of the switches is actuated.

This results in spring forces from two opposite directions in order to hold the actuator in a neutral position. Thus, essentially the same force is required to move the actuator in each direction. This spring action also causes the actuator to be moved to the neutral position as soon as the leg assembly is being moved from a limit position. This means that the leg assembly can all the time be lengthened or shortened when not in a limit position. This also eliminates the risk that the length of the leg assembly is to be changed significantly from the length in a limit position before the length can be changed back to the same limit position. This could be necessary if the actuator is not immediately moved to its neutral position when the leg assembly leaves the limit position.

Each switch prevents, when actuated, the motor from being run in a direction equivalent to that in which the leg assembly has reached its limit position.

This means that the motor can always be run in the opposite direction, i.e. in the direction that moves the leg assembly away from the limit position.

The leg assembly advantageously comprises a third elongate and preferably tubular carrier element, which is directed away from the holder, is arranged non-rotatably relative to the holder and has a thread portion in threaded engagement with a thread of the second carrier element. Preferably, the thread portion of the third carrier element is an internal thread at an end enclosing the second carrier element, in threaded engagement with an external thread along the entire extent of the second carrier element. A second limit position wire interacts, with the aid of a shifter, with the first limit position wire for controlling the actuator when the leg assembly is in its limit position of maximum length.

The second limit position wire is suitably fixed in the shifter for controlling the actuator by means of the limit position wire fixed in the actuator when the leg assembly is in its limit position of maximum length. Moreover, the second limit position wire can have a lower abutment, with which the third carrier element interacts to control the actuator when the leg assembly is in its limit position of maximum length. Finally the third carrier element can be arranged to interact, preferably with the aid of the shifter, with the actuator for controlling the same when the leg assembly is in its limit position of minimum length.

This results in limit switching for a leg assembly with three carrier elements. This leg assembly has a greater range of possible lengths, but at the same time higher demands are placed on the limit position function since the switch cannot be actuated until all three carrier elements have been extended or retracted. This is solved by means of the second limit position wire which interacts with a shifter to actuate the first limit position wire when the leg has been fully extended, i.e. reached its maximum length.

BRIEF DESCRIPTION OF THE DRAWINGS

A currently preferred embodiment of the invention will now be described by way of example with reference to the accompanying drawings.

DESCRIPTION OF A PREFERRED EMBODIMENT

Figure 1:
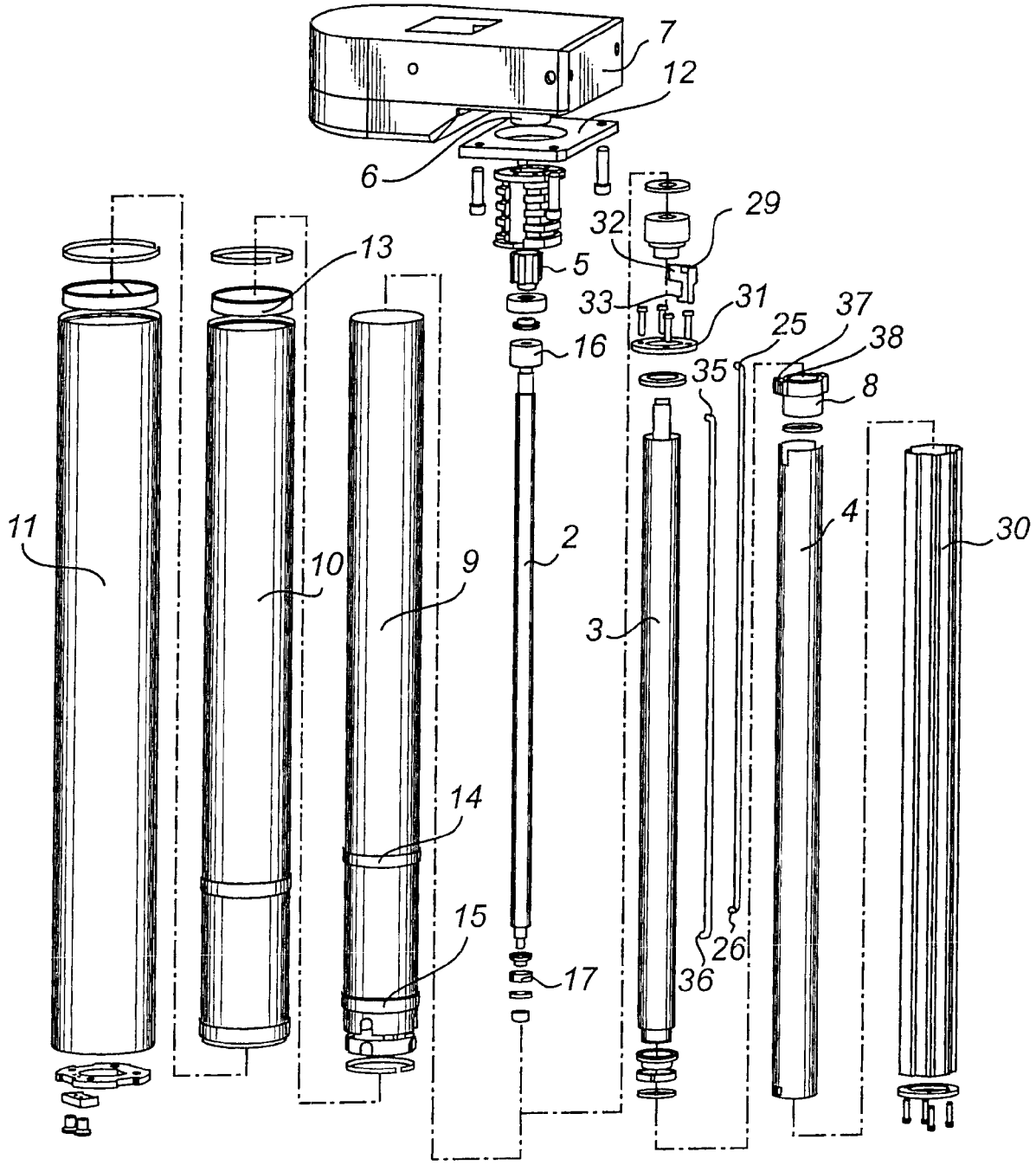
FIG. 1 is an exploded view of a leg assembly according to the invention with its components.
Figure 2:
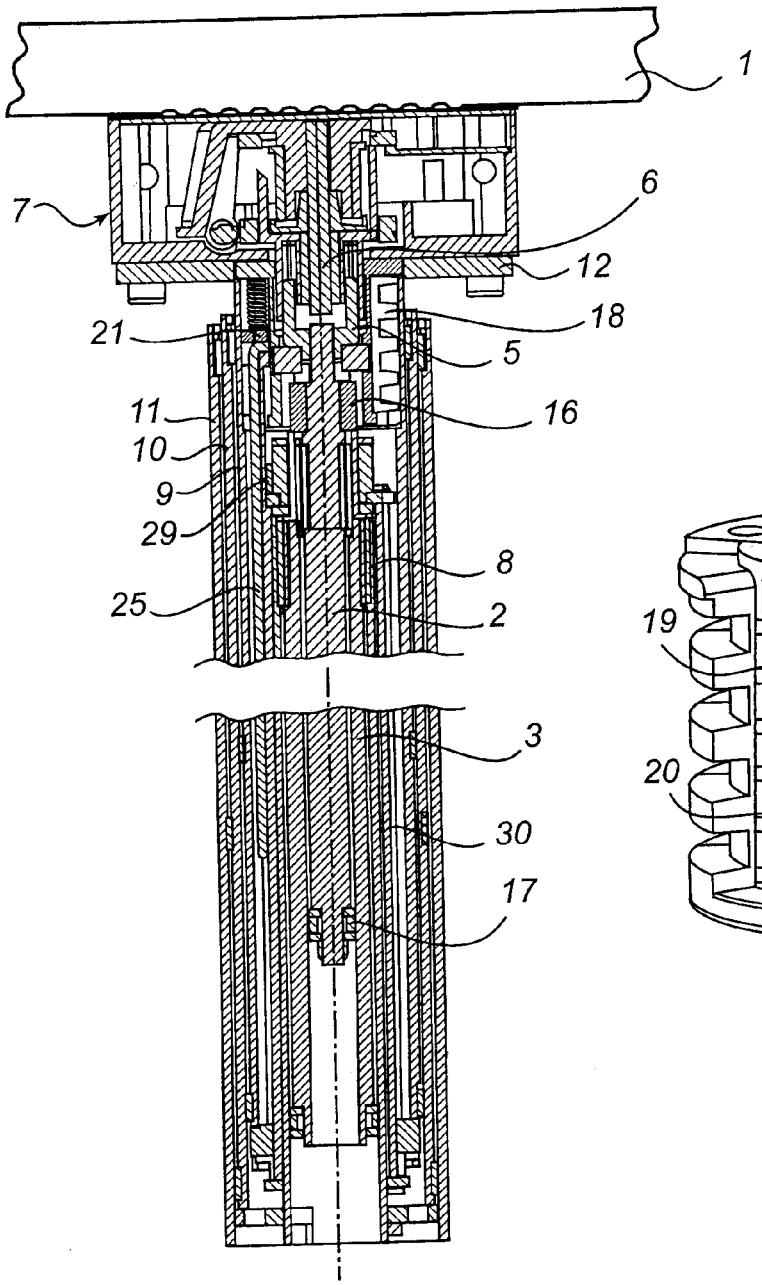
FIG. 2 is cross-sectional view of the leg assembly in FIG. 1 in its mounted state.

FIGS. 1 and 2 illustrate a leg assembly according to the invention. The leg assembly is in FIG. 1 divided so that its essential parts are shown in a spaced-apart manner. FIG. 2 shows the leg assembly in cross-section in a position immediately adjacent to the position of the leg assembly of minimum length.

The leg assembly is adapted to be attached to the underside of a table top 1 or the like, which the user wants to raise or lower. The leg assembly comprises a first, a second and a third elongate carrier element 2, 3, 4. The three carrier elements 2, 3, 4 extend away from the table top 1 and are telescoping in relation to each other, which makes it possible to vary the length of the leg assembly.

The first carrier element 2 has an external thread along its entire extent. The first carrier element 2 is at its end closest to the table top 1 non-rotationally connected with a driver 5. The driver 5 has external teeth which engage in matching notches in an output shaft 6 of a drive assembly with an electric motor in a motor casing 7, which is fixed to the underside of the table top 1. The first carrier element 2 thus rotates when the electric motor causes the driver 5 to rotate, but does not move axially.

The second carrier element 3 consists of a tube. An upper portion of the tube 3 has an internal thread which is in threaded engagement with the external thread of the first carrier element 2. When the first carrier element 2 is caused to rotate by the motor 7 via the driver 5, the second carrier element 3 is moved axially in relation to the first carrier element 2 by the portion of the second carrier element 3 with an internal thread being moved on the external thread of the first carrier element 2.

The second carrier element 3 has an external thread along its entire extent. Also the third carrier element 4 consists of a tube. The third carrier element 4 has an upper portion with an internal thread for threaded engagement with the external thread of the second carrier element 3. The upper portion of the third carrier element 4 comprises a nut 8 which is non-rotationally arranged in the third carrier element 4. When the second carrier element 3 is rotated, the third carrier element 4 is thus moved axially in relation to the second carrier element 3 by the nut 8 being moved on the external thread of the second carrier element 3.

The leg assembly has on its outside tubes which conceal the entire inner structure. As a result, the leg assembly, since its length is changed all the time, has an outer casing without sharp edges. More specifically, the leg assembly has three tubes 9, 10, 11 which are axially displaceable relative to each other. The axial displacement of the tubes 9, 10, 11 follows the axial displacement of the carrier elements 2, 3, 4 relative to each other. The innermost tube 9 is fixedly connected, e.g. welded, to a plate 12. When the table top 1 is raised, the innermost tube 9 thus comes along. The plate 12 and the innermost tube 9 consequently form a holder for the leg assembly. The outermost tube 11 is fixed to the third carrier element 4 and therefore follows the motion thereof in relation to the other carrier elements 2, 3. The intermediate tube 10 has an internal guide ring 13 and the innermost tube 9 has two external guide rings 14, 15, which three guide rings 13, 14, 15 ensure the sliding of the intermediate tube 10 on the innermost tube 9 and prevent the intermediate tube 10 from sliding off the innermost tube 9 during the displacement of the leg.

The first carrier element 2 has expanded portions 16, 17 at both ends. These upper and lower expanded portions 16, 17 prevent the second carrier element 3 from being disengaged from the first carrier element 2. When the second carrier element 3 abuts against the lower expanded portion 17 of the first carrier element 2, it rotates together with the first carrier element 2. This rotation causes the third carrier element 4 to be moved axially on the second carrier element 3.

When the leg assembly reaches a limit position, i.e. when the three carrier elements 2, 3, 4 are maximally retracted into each other or maximally extended from each other, the motor is prevented from driving the carrier elements 2, 3, 4 past their respective limit positions. If the motor could continue to drive the carrier elements 2, 3, 4 in this position, it would encounter great resistance, thus causing great wear. Therefore the leg assembly has a device for interrupting the current to the motor.

Figure 3:
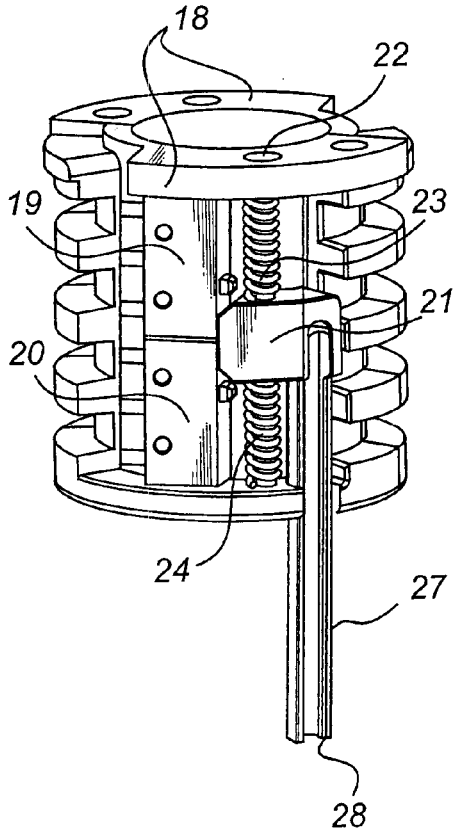
FIG. 3 is a perspective view of a device for interrupting the current to a motor for adjusting the length of the leg assembly.
Figure 6:
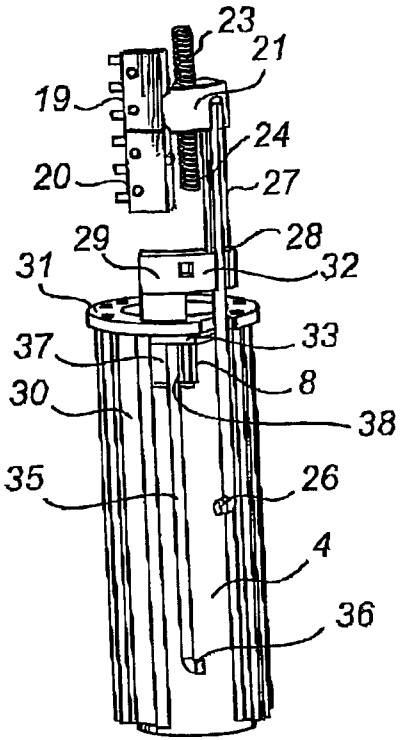
FIGS. 4–6 are perspective views illustrating the limit position function according to the invention.
Figure 5:
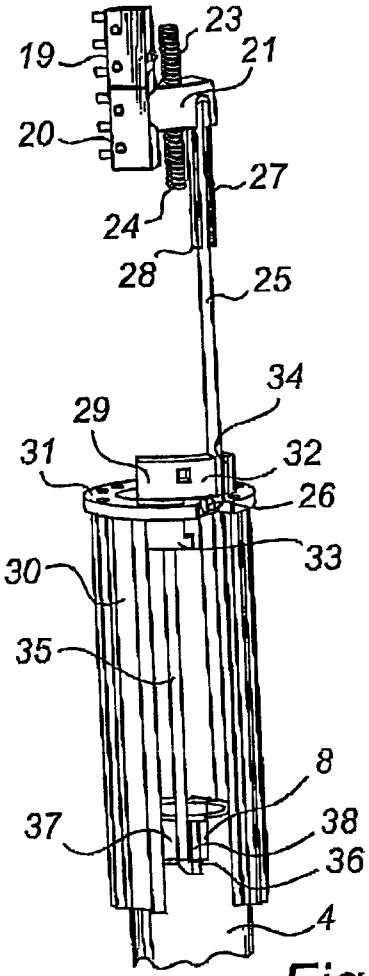
Figure 4:
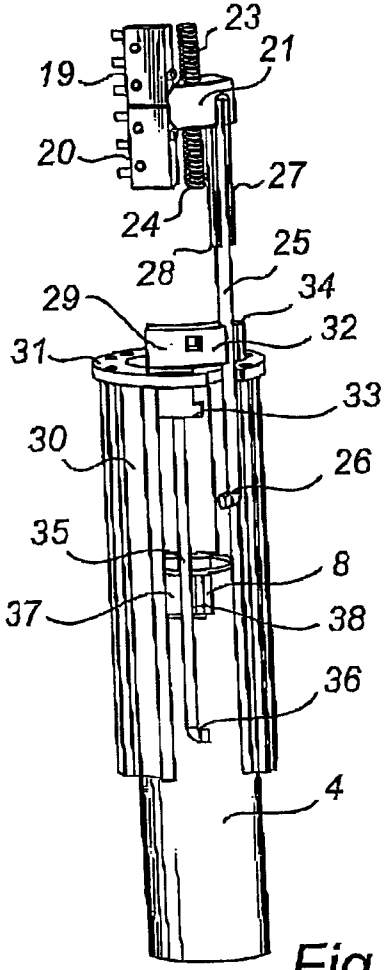

Reference is now made to FIG. 3, in which such a device for interrupting the current is shown in detail, and FIGS. 4–6 which illustrate further components which are operative in the limit position function. More specifically, FIG. 4 shows the components in an intermediate position between the limit positions of maximum length and minimum length, FIG. 5 shows the components in the limit position of maximum length and FIG. 6 shows the components in the limit position of the minimum length.

The device for interrupting the current has a bushing 18 which surrounds the driver 5. Two microswitches 19, 20 are fixed to the bushing 18 in axially spaced-apart positions. The microswitches 19, 20 are in the normal position not actuated, i.e. the current path through each microswitch 19, 20 is uninterrupted. An actuator 21 is mounted on a shaft 22. On the shaft 22 two springs 23, 24 are positioned one on each side of the actuator 21. The two springs 23, 24 urge the actuator 21 towards a normal or neutral position between the two microswitches 19, 20. A first limit position wire 25 is at its upper end fixed to the actuator 21. The limit position wire 25 is arranged to move the actuator 21 when the leg assembly reaches its limit position of maximum length. The actuator 21 then actuates the microswitch 20 so that the current to the motor is interrupted. Then the motor can only be run in a direction that moves the leg assembly away from its limit position. When the leg assembly is moved away from the limit position, the springs 23, 24 immediately return the actuator 21 to the normal position. This means that the motor can again be run in both directions.

The limit position wire 25 extends axially along the leg assembly away from the actuator 21. At its farther end, the limit position wire 25 is bent so as to form an abutment 26. This abutment 26 is used, when the leg assembly reaches its maximally extended position, in such manner that the actuator 21 is pulled away from the table top 1 and actuates the microswitch 20. The limit position wire 25 is at its end closest to the actuator 21 partly extended through a slit sleeve 27 which is part of the actuator 21. The sleeve 27 ends approximately on a level with the expanded portion of the first carrier element 2. The free lower end of the sleeve 27 there constitutes an abutment 28 which can be actuated directly or indirectly by the third carrier element 4 as the leg assembly reaches its position of minimum length. This causes the actuator 21 to actuate the microswitch 19.

Since the leg assembly in the shown and preferred embodiment has three carrier elements 2, 3, 4, the current to motor must not be interrupted until all three carrier elements 2, 3, 4 have been fully retracted or fully extended. A shifter 29 is therefore mounted at the upper end of a non-rotatable sleeve in the form of a pro-filed tube 30 which is arranged to encompass the third carrier element 4 and essentially follow the second carrier element 3 in its motions axially. The profiled tube 30 has a fixed washer 31 at its upper end. The washer 31 has a through opening in which the shifter 29 is arranged. The shifter 29 has flanges 32, 33 on both sides of the opening of the washer 31, which limit the motions of the shifter 29 axially relative to the profiled tube 30. The shifter 29 has a recess 34 in the flange 32 adjacent to the table top 1. In this recess 34 extends the first limit position wire 25.

When the second carrier element 3 reaches its maximally extended position, the shifter 29 will abut against the abutment 26 of the first limit position wire 25, which, however, will not exert any pressure on the actuator 21. A second limit position wire 35 is at its upper end fixed to the shifter 29. The second limit position wire 35 extends axially away from the table top 1 and is at its lower end bent so as to form an abutment 36. A lug 37 on the outside of the nut 8 of the third carrier element 4 has a through opening 38, through which extends the second limit position wire 35. When the third carrier element 4 reaches its maximally extended position, the second limit position wire 35 is pulled away from the table top 1 owing to the engagement between its abutment 36 and the lug 37 of the third carrier element 4. This causes the shifter 29 to be entrained and actuate the first limit position wire 25 so that the actuator 21 is pulled away from the table top 1 and actuates the lower microswitch 20.

When the third carrier element 4 reaches its maximally retracted position, the shifter 29 will, by actuating the sleeve 27, move the actuator 21 upwards, in such manner that the upper microswitch 19 is actuated. More specifically, this is achieved by the third element 4 with its nut 8 pushing the shifter 29 upwards, which then makes direct contact with the abutment 28, i.e. the lower free end of the sleeve 27 included in the actuator 21.

When extending the leg assembly, first the second and third carrier elements 3, 4 move away from the table top 1 along the external thread of the first carrier element 2. When the second carrier element 3 has reached its fully extended position, the third carrier element 4 moves away from the table top 1 along the external thread of the second carrier element 3. When shortening the leg assembly, first the second and third carrier elements 3, 4 move towards the table top 1 along the external thread of the first carrier element 2. When the second carrier element 3 has reached its fully retracted position, the third carrier element 4 moves towards the table top 1 along the external thread of the second carrier element 3.

The device for interrupting the current to the electric motor can, of course, be used even if the leg assembly has only two carrier elements. In that case, the shifter 29 is not necessary, but the second carrier element 3, which in this case is non-rotatable, can be arranged to act directly on the limit position wire 25. When the second carrier element 3 reaches its fully extended position, a washer 31 corresponding to the washer arranged at the upper end of the second carrier element 3 thus moves the limit position wire 25 away from the table top 1 by engagement with the abutment 26 of the limit position wire 25. As a result, the current to the motor is interrupted as described above by the lower microswitch 20 being actuated. When the second carrier element 3 reaches its fully retracted position, said washer at the upper end of the second carrier element 3 can press the sleeve 27 upwards, so that the current to the motor is interrupted as described above by the upper microswitch 19 being actuated.

It will be appreciated that many modifications of the embodiment described above are feasible within the scope of the invention as defined by the appended claims. For instance, the springs 23, 24, which urge the actuator 21 towards its neutral position, could be replaced by a single rigid spring, which would then generate an opposite force when being extended or compressed. Moreover, the first carrier element can be a tube having an internal thread portion at an end enclosing the second carrier element, in threaded engagement with an external thread along the entire length of the second carrier element. In the case with three carrier elements, the second carrier element is also a tube with an internal thread portion at an end enclosing the third carrier element, in threaded engagement with the an external thread along the entire length of the third carrier element.

What is claimed is:

1. A longitudinally adjustable leg assembly, comprising a holder which is adapted to be fixed to the underside of a table top;

first and second elongate carrier elements which are directed away from the holder and cooperate by threaded engagement, the first carrier element being mounted rotatably but axially immovably in the holder and one of the first and second carrier elements having an external thread and the other of the first and second carrier elements being a tube having an internal thread portion at one end in threaded engagement with the external thread;

an electric motor for rotating the first carrier element;

and a device for interrupting the current to the motor when the leg assembly is in a limit position of maximum or minimum length and characterised by the device for interrupting comprising two switches and an actuator, which is adapted to actuate one of the two switches when the leg assembly is in the limit position of maximum length and the other of the two switches when the leg assembly is in the limit position of minimum length, wherein a limit position wire is attached to the actuator for controlling the same when the leg assembly is in its limit position of maximum length.

2. An adjustable leg assembly as claimed in claim 1, in which the device for interrupting with its two switches is arranged at an upper end of the first carrier element.

3. A longitudinally adjustable leg assembly as claimed in claim 1, in which the limit position wire has a lower abutment, with which the second carrier element interacts to control the actuator when the leg assembly is in its limit position of maximum length.

4. A longitudinally adjustable leg assembly as claimed in claim 1, in which the second carrier element is adapted to interact with the actuator for controlling the same when the leg assembly is in its limit position of minimum length.

5. A longitudinally adjustable leg assembly as claimed in claim 1, which comprises a third elongate carrier element which is directed away from the holder, is arranged non-rotatably relative to the holder and has a thread portion for threaded engagement with a thread on the second carrier element, and a second limit position wire which, with the aid of a shifter, interacts with the first limit position wire for controlling the actuator, when the leg assembly is in its limit position of maximum length.

6. A longitudinally adjustable leg assembly as claimed in claim 5, in which the second limit position wire is attached to the shifter for controlling the actuator via the first limit position wire attached to the actuator, when the leg assembly is in its limit position of maximum length.

7. A longitudinally adjustable leg assembly as claimed in claim 6, in which the second limit position wire has a lower abutment with which the third carrier element interacts to control the actuator, when the leg assembly is in its limit position of maximum length.

8. A longitudinally adjustable leg assembly as claimed in claim 5, in which the third carrier element is adapted to interact with the actuator, for controlling the same, when the leg assembly is in its limit position of minimum length.

9. A longitudinally adjustable leg assembly as claimed in claim 8, in which the third carrier element is adapted to interact with the actuator with the aid of the shifter.

10. A longitudinally adjustable leg assembly as claimed in claim 1, in which the actuator is spring actuated towards a neutral position where none of the switches is actuated.

11. A longitudinally adjustable leg assembly as claimed in claim 10, in which the device for interrupting comprises two springs which each from its own direction press the actuator towards the neutral position where none of the switches is actuated.

12. A longitudinally adjustable leg assembly as claimed in claim 1, in which each switch, when actuated, prevents the motor from being run in a direction equivalent to the direction in which the leg assembly has reached its limit position.

* * * * *